US005996884A

United States Patent [19]

Frisk et al.

[11] Patent Number: 5,996,884

[45] Date of Patent: Dec. 7, 1999

[54] HYBRID CONTAINER HAVING A RIGID BODY AND POLYMER FILM ENDS

[75] Inventors: Peter Frisk, Chicago; Craig Witty, Winnetka, both of Ill.

[73] Assignee: Pepsico, Inc., Purchase, N.Y.

[21] Appl. No.: 08/991,151

[22] Filed: Dec. 16, 1997

[51] Int. Cl.[6] ..... B65D 5/36

[52] U.S. Cl. ..... 229/117.16; 229/143; 229/125.39; 229/110; 383/104; 383/119; 383/210

[58] Field of Search ..... 229/193, 143, 229/110, 125.39, 117.16; 383/104, 119, 210

[56] References Cited

U.S. PATENT DOCUMENTS

| | | | |
|---|---|---|---|
| 2,209,200 | 7/1940 | Hanson | 229/193 X |
| 3,339,721 | 9/1967 | Goldstein | 383/104 X |
| 3,640,381 | 2/1972 | Kanada et al. | 383/119 X |
| 3,659,777 | 5/1972 | Kanada et al. | 383/104 |
| 3,896,991 | 7/1975 | Kolowski et al. | 383/119 X |
| 4,082,216 | 4/1978 | Clarke | 383/104 X |
| 4,512,563 | 4/1985 | Ward | 383/104 X |
| 4,818,545 | 4/1989 | Kunimoto | 383/104 X |
| 4,903,859 | 2/1990 | Derby et al. | 383/104 X |
| 5,037,138 | 8/1991 | McClintock et al. | 383/210 X |
| 5,462,222 | 10/1995 | Boeck, II | 229/125.39 |
| 5,654,051 | 8/1997 | Andersson et al. . | |
| 5,725,309 | 3/1998 | Robinson | 383/104 X |

FOREIGN PATENT DOCUMENTS 0722892 7/1996 European Pat. Off. .

*Primary Examiner*—Gary E. Elkins
*Assistant Examiner*—Tri M. Mai
*Attorney, Agent, or Firm*—Fitzpatrick, Cella, Harper & Scinto

[57] ABSTRACT

A novel hybrid beverage container having a rigid body and flexible polymer film ends is disclosed herein. The hybrid container may be folded in a closed state for storage, and erected for a filling state. The top end of the container has a recloseable access for filling and sealing the container with a beverage. The container may also have a handle device. In one preferred embodiment, the rigid body is composed of a polyethylene coated fiberboard material. In another embodiment, the rigid body is composed of a mineral filled polyolefin.

12 Claims, 9 Drawing Sheets

HYBRID CONTAINER HAVING A RIGID BODY AND POLYMER FILM ENDS

BACKGROUND OF THE INVENTION

1. Field of the Invention

The present invention relates to containers for beverages. Specifically, the present invention relates to a beverage container having a body composed of a rigid material and ends composed of a polymer film.

2. Description of the Related Art

Restaurants and especially fast food restaurants have a strong need for disposable containers for beverages. Disposable containers for beverages are numerous and have certain advantages and disadvantages. These beverage containers run the gamut from glass to polyester to fiberboard to aluminum. Most such containers are recyclable which mitigates the disposability aspect of such containers. However, storage of such containers on site, for example at a fast food restaurant, presents a problem due to the need for a large storage space depending on the container. Also, the desire of most fast food restaurants to use fountain dispensers instead of prepackaged beverage containers eliminates containers such as aluminum cans from meeting the needs of these fast food restaurants. Another desire of fast food restaurants is to allow the fast food restaurant employee perform several tasks related to a customer's order while a beverage is being prepared for the customer which eliminates containers incapable of maintaining an open filling state without the assistance of an employee.

Stackable fiberboard cups have been the most popular solution to a fast food restaurant's needs, however, storage of the cups requires sufficient space in the tight confines of the "kitchen" of a fast food restaurant. Other solutions such as flexible pouches do not meet the open filling state requirement thereby occupying the time of a fast food employee at the beverage dispenser.

There still remains a need for a beverage container which occupies a minimal space during storage, is capable of maintaining an open filling state, and is large enough to contain a family size volume of beverage for transport from a fast food restaurant to a customer's work or home.

BRIEF SUMMARY OF THE INVENTION

One aspect of the present invention is a beverage container having a body, a top end and a bottom end. The body defines an interior of the container and has an interior and an exterior surface. The body is composed of a rigid material. The bottom end is composed of a polymer film and is sealed to the body. The top end is composed of a polymer film and is sealed to the body. The top end has a closeable access for filling the container with a beverage through the access before sealing for transport.

Another aspect of the present invention is a hybrid container for a beverage. The hybrid container includes a rigid body, a top end and a bottom end. The rigid body has a first sheet and a second sheet with each of the sheets having a plurality of side panels. The first sheet is attached to the second sheet at the first and last side panels of the plurality of side panels. The flexible plastic film bottom end is attached to a lower end of each of the first and second sheets. The flexible plastic film top end is attached to an upper end of each of the first and second sheets. The top end has a resealable opening for accessing the interior of the hybrid container. The plurality of panels of each of the sheets of the rigid body and the flexible plastic top and bottom ends allow for the hybrid container to be modified from a substantially flat state to an erected filling state.

It is a primary objective of the present invention to provide a container which may be stored substantially flat and then erected for filling.

It is an additional objective of the present invention to provide a hybrid container composed of a rigid material such as fiberboard and a flexible material such as a plastic film.

It is an additional objective to provide a hybrid container having a resealable opening.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of a preferred embodiment of the hybrid container of the present invention in a open-filling state;

Figure 1:
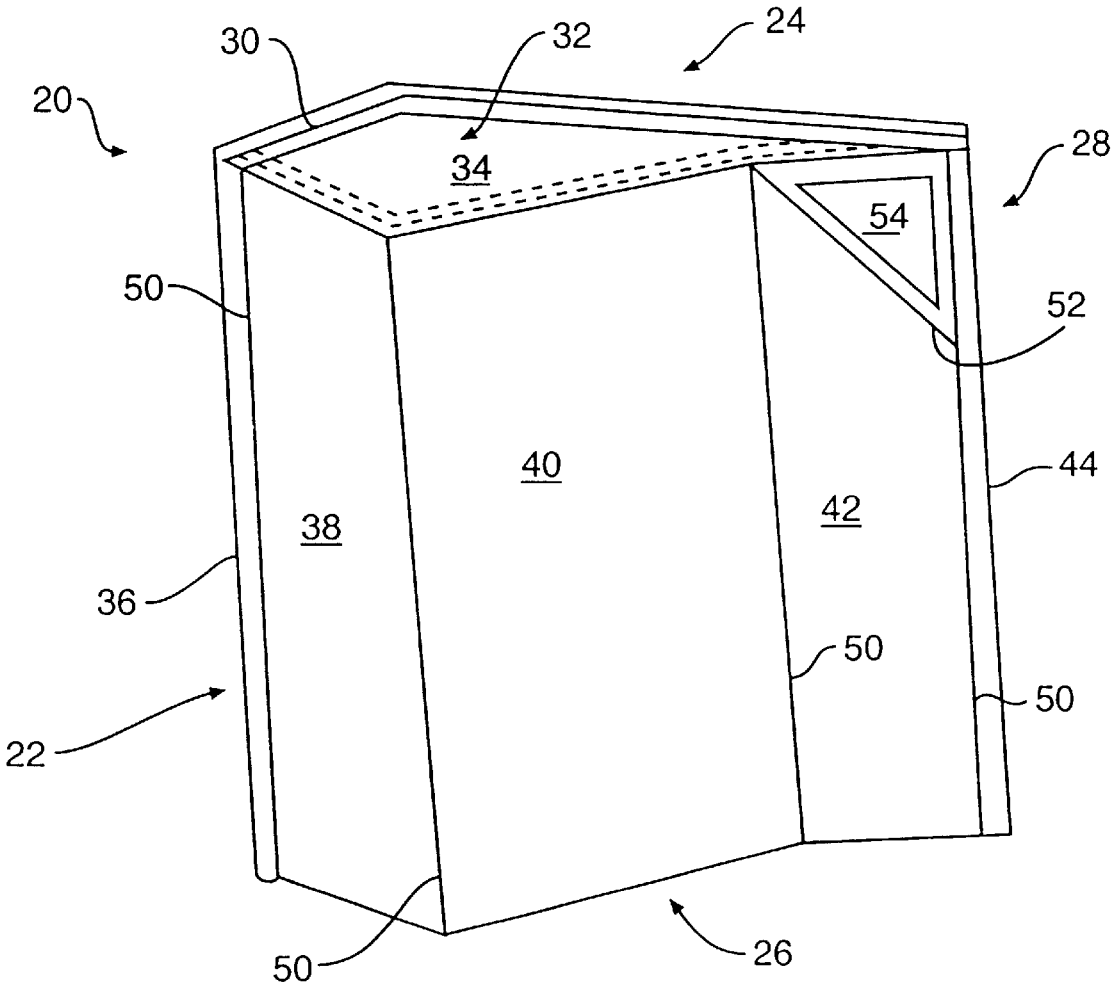
Figure 2:
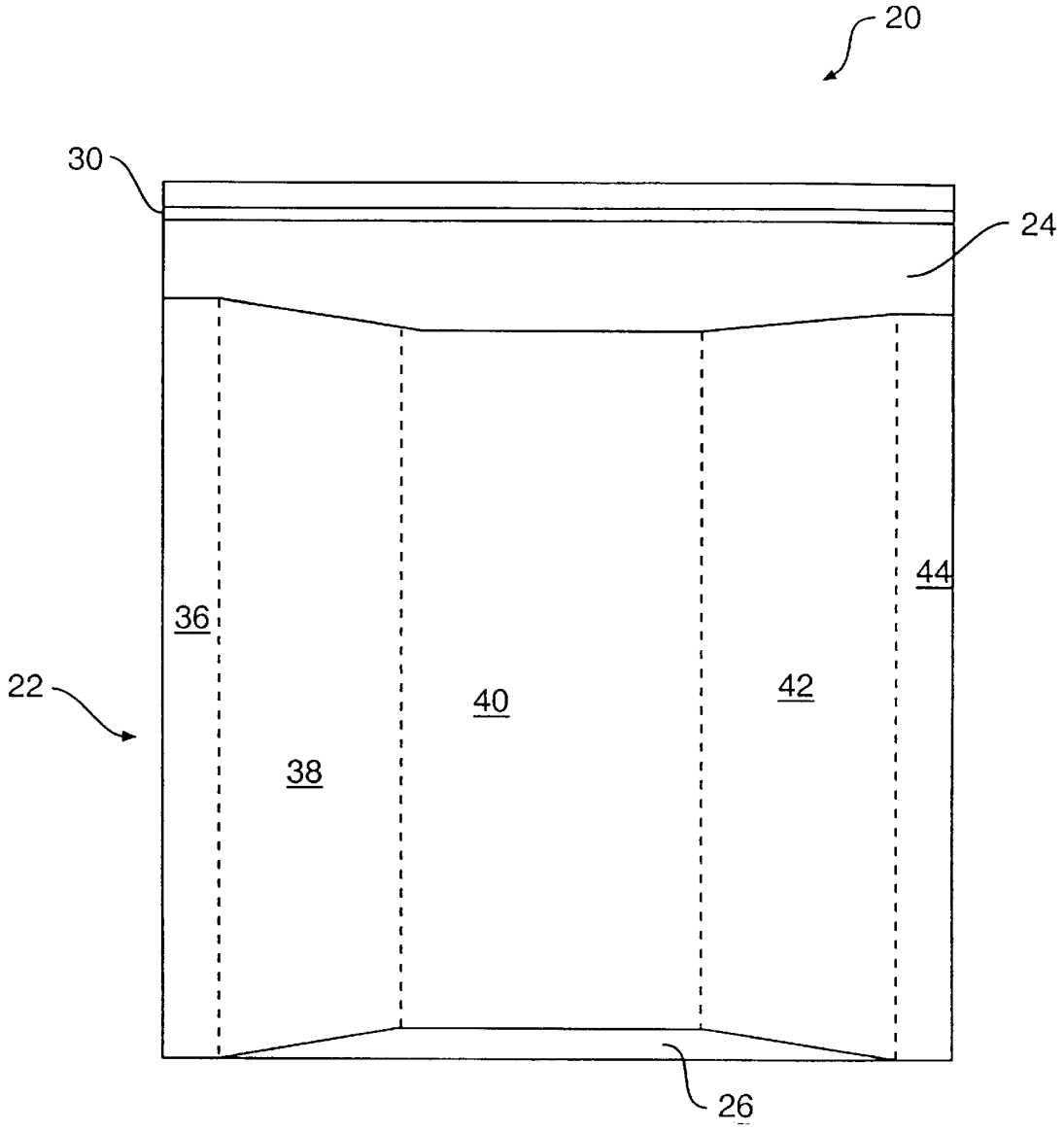
Figure 3:
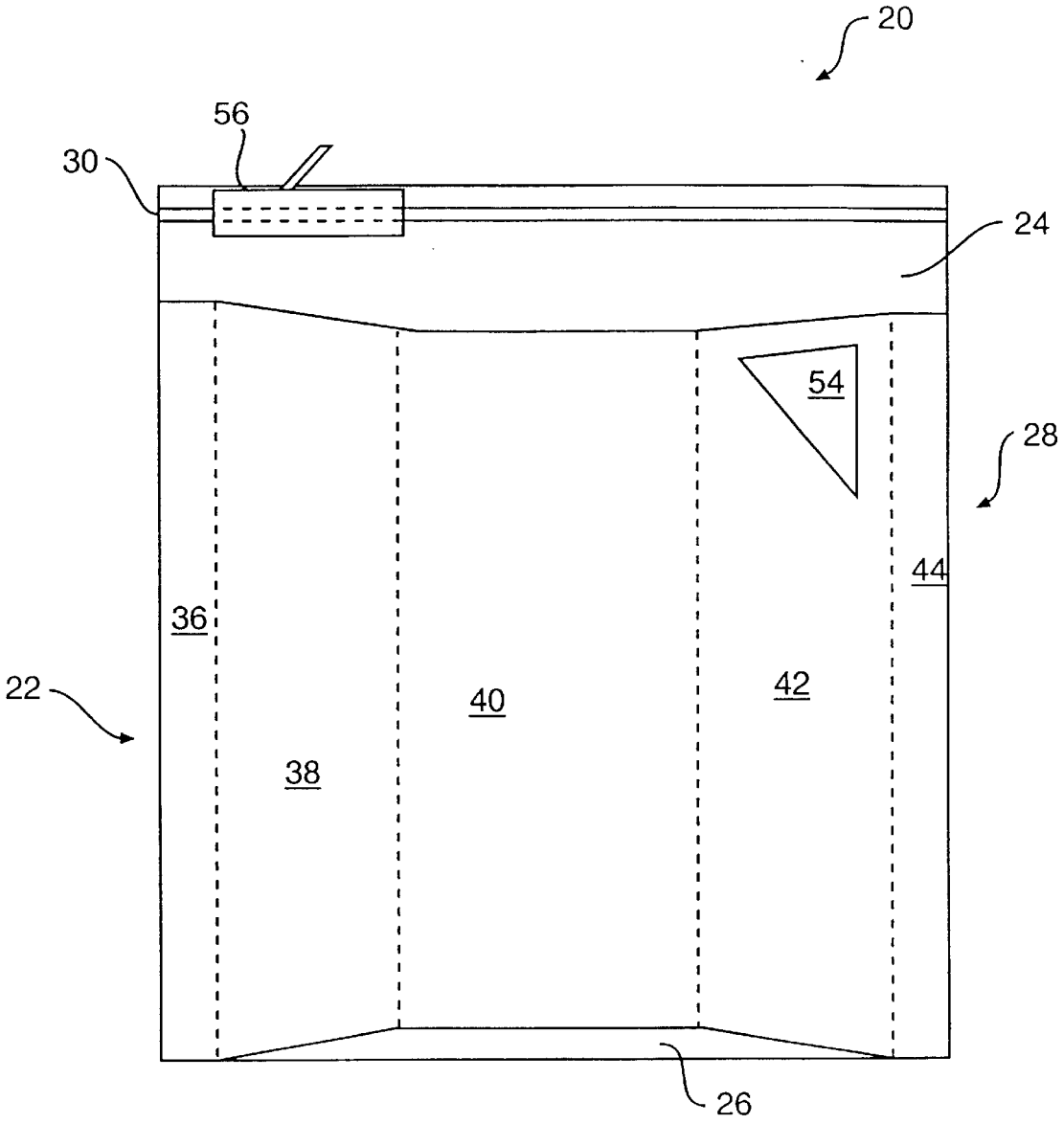
Figure 4:
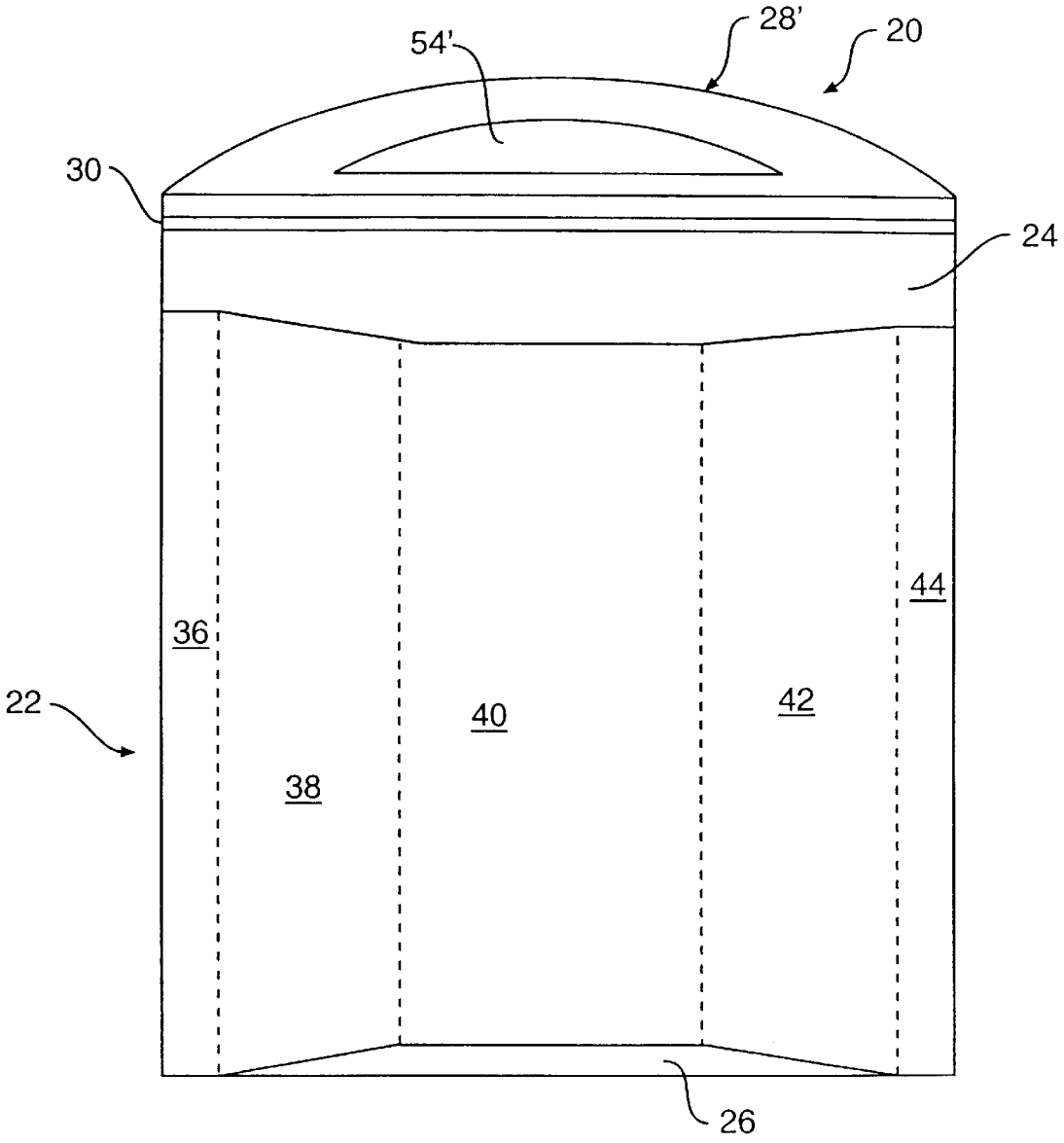
Figure 5:
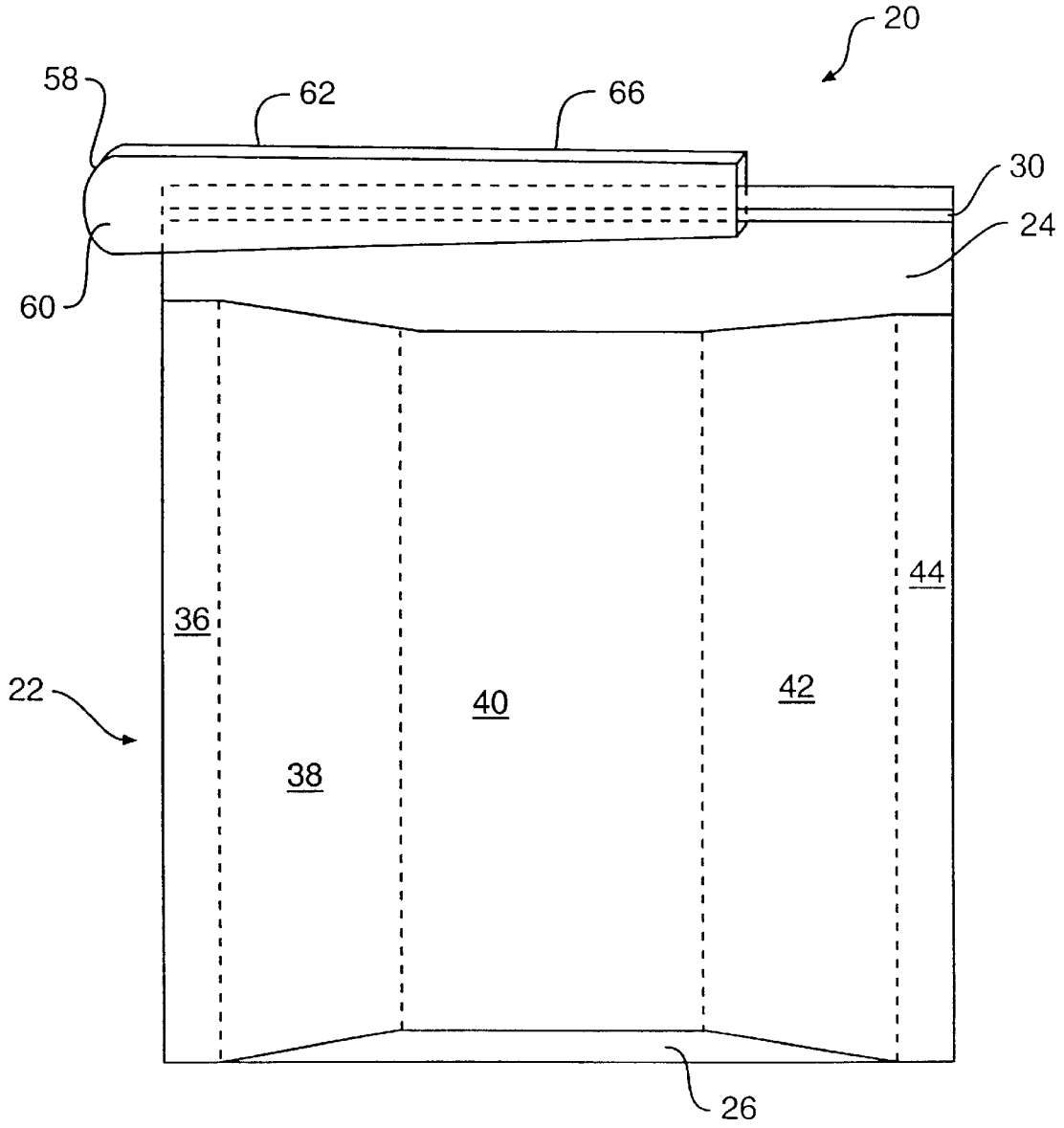
Figure 6:
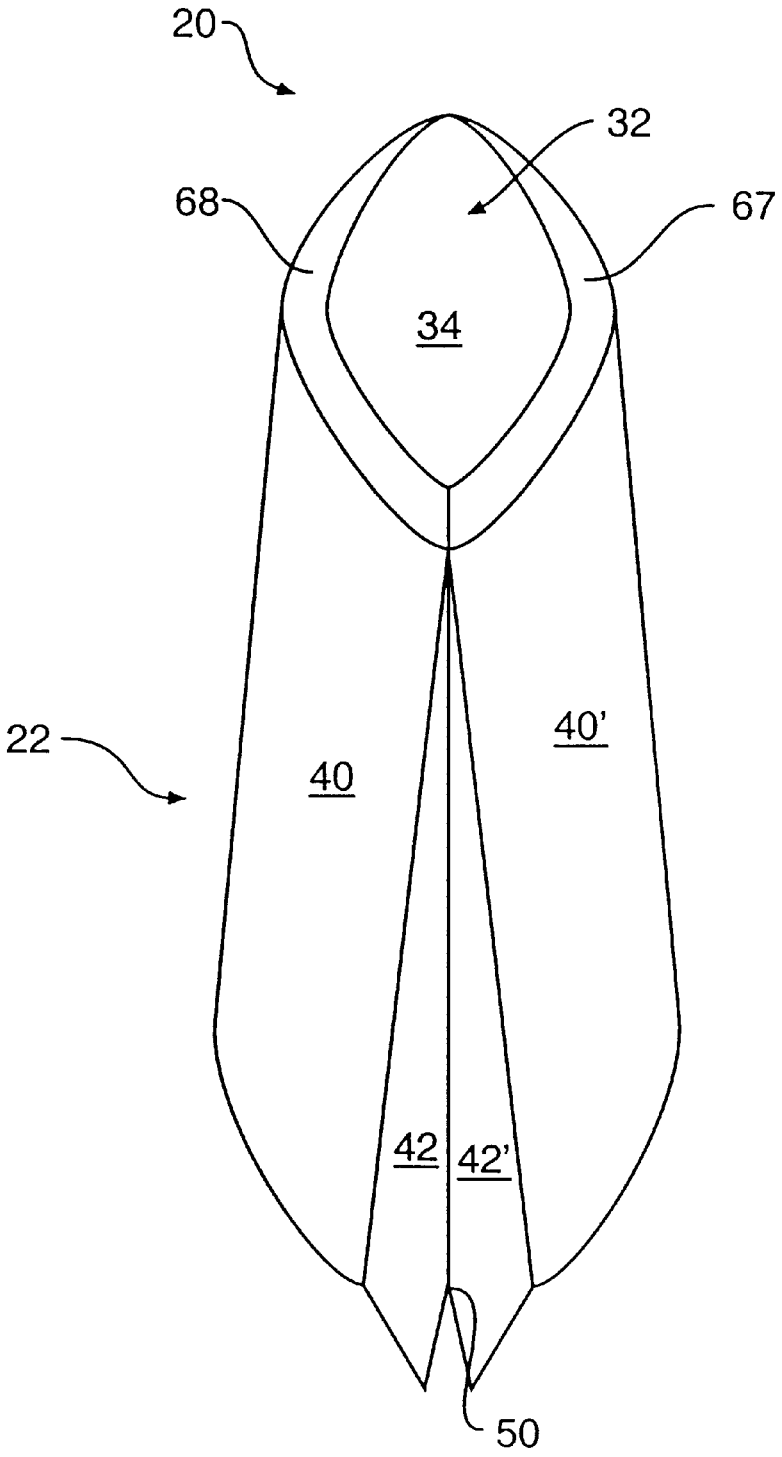
Figure 7:
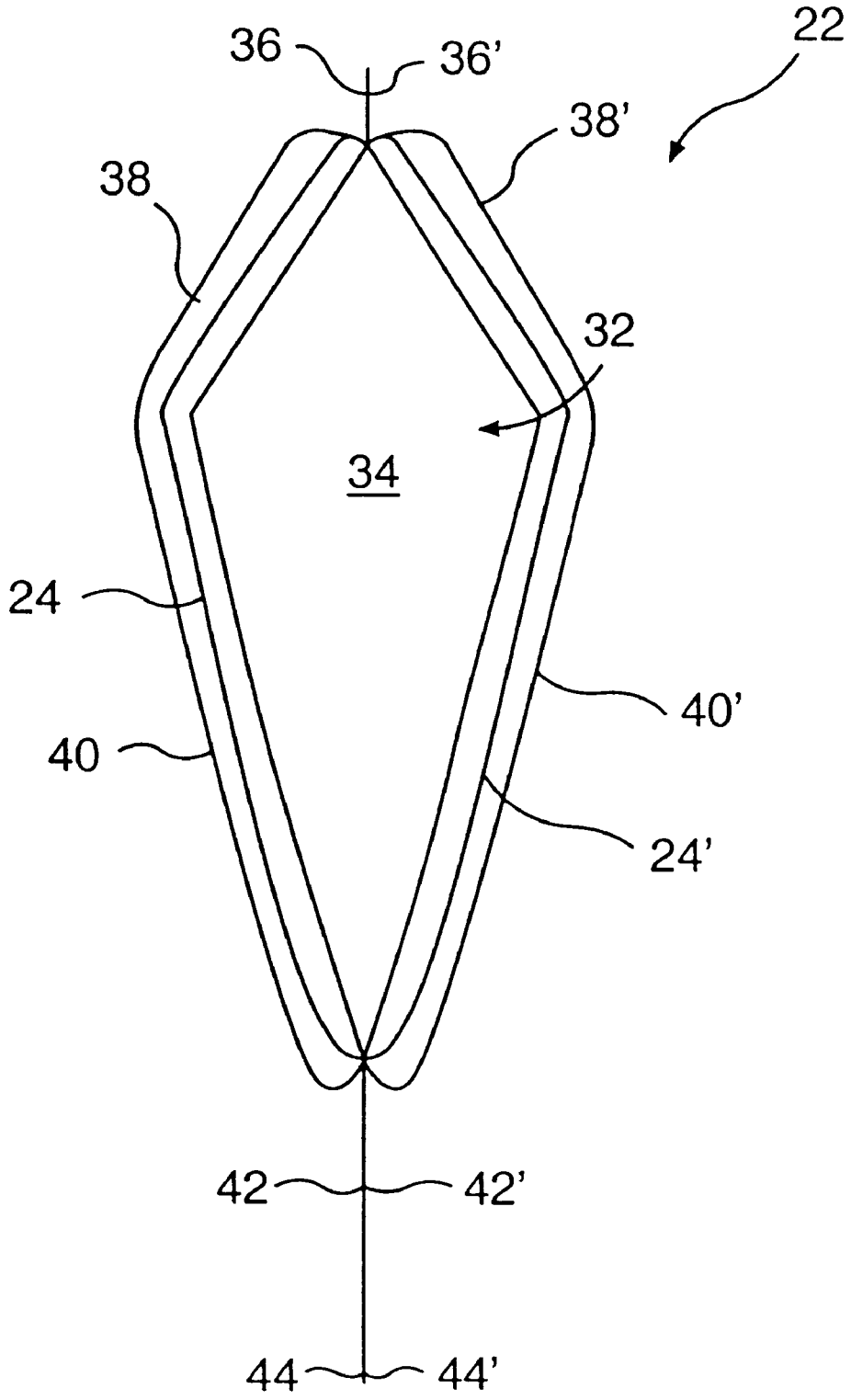
Figure 8:
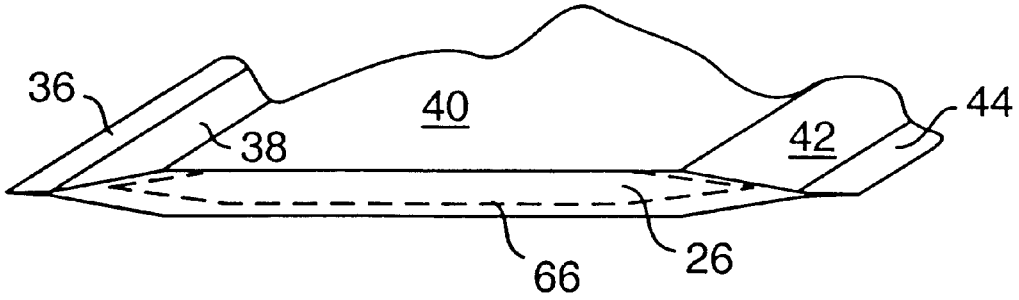
Figure 9:
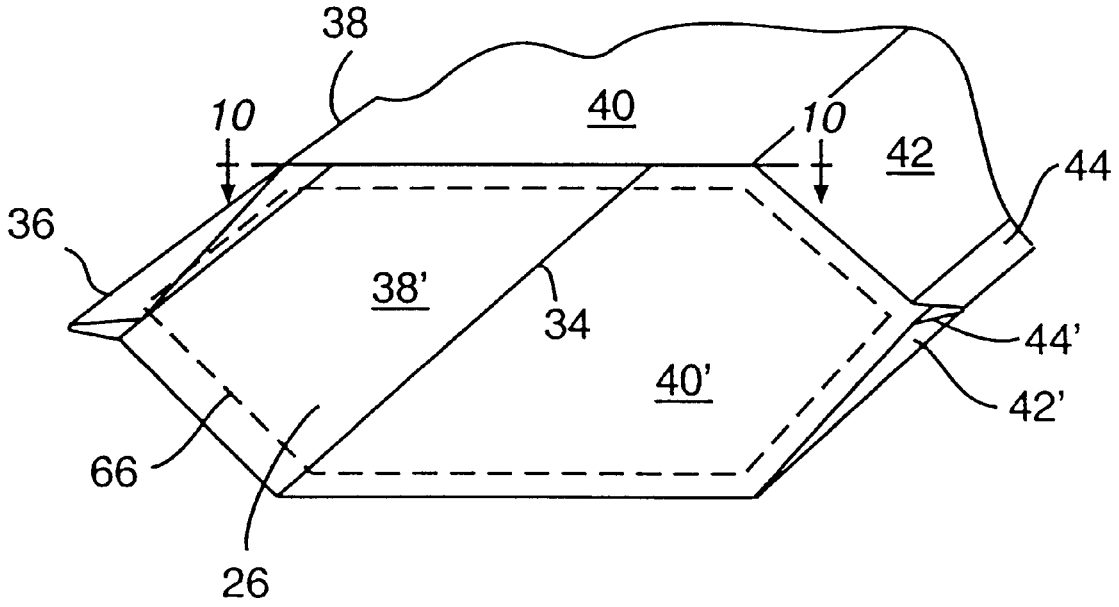
Figure 10:
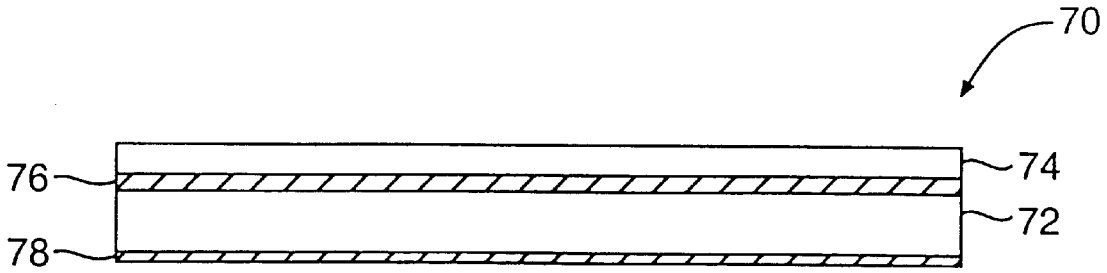
Figure 11:
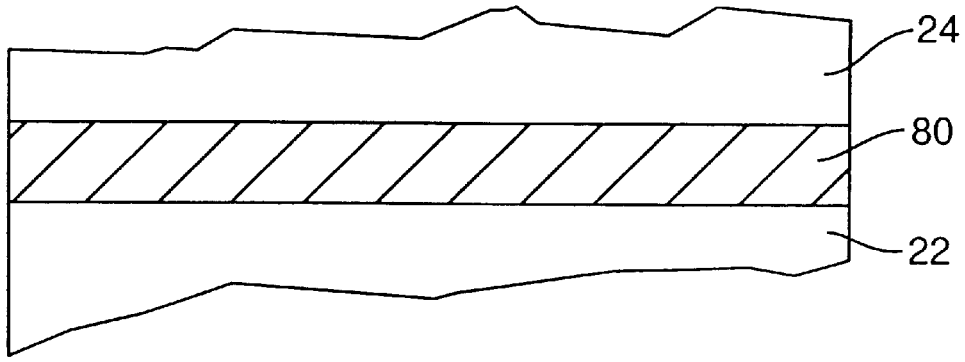

There is illustrated in FIG. 2 a side view of an alternative embodiment of the hybrid container of the present invention in a closed-prefilling state;

There is illustrated in FIG. 3 a side view of an alternative embodiment of the hybrid container of the present invention in a closed-prefilling state;

There is illustrated in FIG. 4 a side view of an alternative embodiment of the hybrid container of the present invention in a closed-prefilling state;

There is illustrated in FIG. 5 a side view of an alternative embodiment of the hybrid container of the present invention in a closed-prefilling state;

There is illustrated in FIG. 6 a perspective rear view of the hybrid container of FIG. 1;

There is illustrated in FIG. 7 a top plan view of the hybrid container of FIG. 1;

There is illustrated in FIG. 8 a perspective bottom view of the hybrid container of the present invention in a closed-prefilling state;

There is illustrated in FIG. 9 a perspective bottom view of the hybrid container of the present invention in an open-filling state;

There is illustrated in FIG. 10 a cross-section along line 10—10 of FIG. 9;

There is illustrated in FIG. 11 an interior view of the top of the hybrid container of the present invention.

DETAILED DESCRIPTION OF THE INVENTION

The novel hybrid container of the present invention is directed toward fulfilling the need for the short term .packaging of a beverage in a container with a self maintaining open filling state, and without a tremendous space requirement for storage. However those skilled in the pertinent art will recognize that other applications of the hybrid container of the present invention are well within the scope and spirit of the present invention.

As shown in FIG. 1, a hybrid container 20 generally includes a rigid body 22, a flexible plastic top end 24, a flexible plastic bottom end 26, a handle 28 and a resealing mechanism 30. The flexible plastic top end 24 has an opening 32 allowing for access to the interior 34 of the container 20. The interior 34 is accessed by the resealing mechanism 30.

The rigid body 22 may be composed of several different materials. A preferred material is a fiberboard coated with polyethylene on its interior and exterior surfaces. An alternative material is a mineral filled polyolefin material such as described in Andersson et al, U.S. Pat. No. 5,654,051 for a Packaging Material And Packaging Containers Produced Therefrom, issued on Aug. 5, 1997, which relevant parts are hereby incorporated by reference.

The rigid body 22 may be composed of first, second, third, fourth and fifth panels 36, 38, 40, 42, 44 on one side and a mirror set of panels 36', 38', 40', 42', 44', not shown, on the other side. The panels 36, 38, 40, 42, 44 are defined by a series of crease lines 50. Although the panels 36, 38, 40, 42, 44 may be of any size relative to each other, a preferred embodiment has panel 40 twice the size of panel 38 which is equal in size to panel 42.

A preferred embodiment of the hybrid container 20 is designed to contain two liters of a beverage product such as a cola drink. However those skilled in the pertinent art will recognize that the present invention may be designed to accommodate various volumes of product.

The panels 36, 38, 40, 42, 44 allow the container 20 to be substantially flat in a closed-prefilling state. The panels 36, 38, 40, 42, 44 also allow the rigid body 22 to bulge out during a filling state in which the opening 32 must stay open in order to fill the container 20 without the constant presence of a beverage filling operator, not shown. The operation of the container will be further described below.

In a preferred embodiment, panel 42 has a handle aperture 54 cut therethrough and a diagonal heat seal 52 which together form a handle 28 for use by a consumer. The heat seal 52 seals off the section of panels 42 and 42' from the interior 34 of the container 20. Additionally, panels 36, 36', 44 and 44' are all sealed from the interior 34 by a similar heat sealing along their respective crease lines 50.

The flexible plastic top end 24 may be attached to the rigid body 22 through various means. A preferred means is heat sealing of an overlapping portion, not shown, of top end 24 to rigid body 22. This is easily performed if rigid body 22 has a polyethylene coating thereon. Other contemplated attachment means include ultrasonic sealing, stitching, and adhesive sealing.

The top end 24 is generally one piece with a resealing mechanism 30 through the center which allows for an opening in the top end 24. The resealing mechanism may be a strip, or a series of strips or perforations which allow for the resealing and opening of the top end similar to a recloseable flexible pouch.

FIGS. 2–5 illustrate side views of various embodiments of the hybrid container 20 of the present invention with different top ends 24, and specifically different resealing mechanisms 30. FIG. 2 is similar to FIG. 1 except for the absence of a handle 28. FIG. 3 is similar to FIG. 1 except for the presence of zipper mechanism 56 for facilitating the opening and resealing of the top end 24. FIG. 4 is similar to FIG. 1 except that the handle 28' is built into the top end 24 and handle aperture 54' is cut through one or both sides of the top end 24 which come together upon resealing. More specifically, the arcuate portion of the top end 24 illustrated in FIG. 4 may only be present on one flap of top end 24 to prevent interference during filling of the container 20. FIG. 5 is similar to FIG. 1 except that a clip 58 is used as a handle. The clip 58 has a first side 60 and a second side 62 which mate to provide a channel 66 in which a portion of the top end 24 is held. The clip 58 may act as a handle.

FIG. 6 illustrates the bulging of the container 20 during the open filling state during which top end 24 may be further defined as having a first flap 67 and a second flap 68. FIG. 7 illustrates a top plan view looking into the container 20. As shown, panels 36 and 36' are sealed to each other and panels 44 and 44' are sealed to each other. Although panels 42 and 42' appear to be sealed to each other, only the top portion above diagonal seal 52 are exactly sealed to each other. The dashed lines show the bulging of the rigid body 22.

FIGS. 8 and 9 illustrate the bottom of the container 20. The flexible plastic bottom end 26 is sealed to the rigid body in a similar fashion as the top end 24. The bottom end and the top end may be composed of most flexible plastic materials. Such materials may include polypropylene, a blend of polyethylene, a nylon, a polyvinyl dichloride, and the like. A dashed line 66 designates the seal line of the bottom end 26 to the rigid body 22. As shown, the container is substantially flat in FIG. 8 while bulging in FIG. 9.

To illustrate the sealing of the bottom end 26 to the rigid body 22, FIG. 10 is cross section along line 10—10 of FIG. 9. The cross-section 70 may be similar to the cross-section for the top end 24 and the rigid body 22. A fiberboard layer 72 is coated with polyethylene layers 76 and 78 on both surfaces. The flexible plastic material layer 74 of bottom end 26 is attached to polyethylene layer 76. If the rigid body is composed of the afore-mentioned mineral filled polyolefin material, then layer 74 may be attached directly to a corresponding layer 72.

FIG. 11 illustrates the overlap in the interior of the upper area of the rigid body 22. The overlap area 80 divides all flexible plastic top end 24 from all rigid body 22. Such an overlap section would form an interior perimeter inside the interior 34 of the container 20. A similar overlap area 80 may be found where the bottom end 26 meets the rigid body 22.

In operation, a gross of hybrid containers 20 may be stored substantially flat in a closed-prefilling state at a restaurant such as a fast food restaurant. The closed-prefilling state is best illustrated in FIG. 8. When a consumer desires a "family" size volume of a beverage for a "To-Go" order, then a single container 20 is removed from the gross and compressed from both sides into an erect open-filling state in which resealing mechanism. 30 is not sealed thereby providing opening 32. The erect container is placed under a standard beverage dispenser and filled without the constant presence of a restaurant employee. This is possible because of the rigid body 22 which maintains the container 20 in its open-filling state when erected thereby allowing the restaurant employee to perform other tasks related to the To-Go order from the consumer. Once the container. 20 is filled (most dispensers are capable of being set for a predetermined volume such as two liters), the resealing mechanism is sealed thereby closing the opening allowing for the transportation of the beverage with a low probability of spillage of the beverage. The container 20 only needs minimal barrier properties due to the consumption of the beverage shortly after purchase from the restaurant.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A hybrid container for a beverage, the hybrid container comprising:

a rigid body having a first sheet and a second sheet, each of the sheets having at least five side panels, the first sheet attached to the second sheet at the first and last side panels of the at least five side panels;

a flexible plastic film bottom end attached to a lower end of each of the first and second sheets; and a flexible plastic film top end attached to an upper end of each of the first and second sheets, the top end having a resealable opening for accessing the interior of the hybrid container;

whereby the at least five panels of each of the sheets of the rigid body and the flexible plastic top and bottom ends allow for the hybrid container to be modified from a substantially flat state to an erected filling state.

2. The hybrid container according to claim 1 wherein the rigid body is a fiberboard material coated with polyethylene.

3. The hybrid container according to claim 1 wherein the flexible plastic top end further comprises a resealable strip.

4. The hybrid container according to claim 1 further comprising a handle mechanism.

5. The hybrid container according to claim 4, wherein the handle mechanism is disposed in one of the side panels adjacent the first side panel in each of the first and second sheets.

6. The hybrid container according to claim 5, wherein the handle mechanism is isolated from the interior of the hybrid container by a seal.

7. The hybrid container according to claim 1 wherein the flexible plastic film top end and bottom end comprises at least one polyethylene layer.

8. The hybrid container according to claim 1 wherein the rigid body is composed of a mineral filled polyolefin material.

9. The hybrid container according to claim 1 wherein the flexible plastic film top end and bottom end are composed of a polypropylene material.

10. The hybrid container according to claim 1, wherein the side panel disposed in the middle of each of the first and second sheets is wider than remaining side panels.

11. The hybrid container according to claim 1, wherein the flexible plastic film bottom end is discrete from the rigid body.

12. The hybrid container according to claim 1, wherein the flexible plastic film top end is discrete from the rigid body.

* * * * *